United States Patent [19]

Yagi

[11] Patent Number: 4,817,525

[45] Date of Patent: Apr. 4, 1989

[54] METHOD AND APPARATUS FOR SYNCHRONOUSLY CONTROLLING THE PRINTING SPEED OF BELT-TYPE PRINTING MACHINE

[75] Inventor: Toshimasa Yagi, Kasugai, Japan

[73] Assignee: Isowa Industry Co., Ltd., Nagoya, Japan

[21] Appl. No.: 70,583

[22] Filed: Jul. 7, 1987

[30] Foreign Application Priority Data

Jul. 8, 1986 [JP] Japan ..... 61-160535

[51] Int. Cl.[4] ..... B41F 5/04

[52] U.S. Cl. ..... 101/219; 101/DIG. 48

[58] Field of Search ..... 101/181, 228, 219, 245, 101/DIG. 27; 198/575, 577, 855; 226/2, 6, 10, 24, 38

[56] References Cited

U.S. PATENT DOCUMENTS

| | | | |
|---|---|---|---|
| 3,518,940 | 7/1970 | Stroud et al. | 101/223 |
| 3,934,505 | 1/1976 | Kushner | 101/181 |
| 3,963,902 | 6/1976 | Dowd | 101/181 |
| 4,114,534 | 9/1978 | Kudlich et al. | 101/181 |
| 4,363,270 | 12/1982 | Ury et al. | 101/181 |
| 4,538,516 | 9/1985 | Aaron | 101/219 |

FOREIGN PATENT DOCUMENTS

| | | | |
|---|---|---|---|
| 0029312 | 5/1981 | European Pat. Off. . | |
| 5110128 | 4/1951 | Japan . | |
| 50-3042 | 1/1975 | Japan . | |
| 56-123863 | 9/1981 | Japan . | |
| 52655 | 3/1984 | Japan | 101/DIG. 27 |
| 59-42957 | 3/1984 | Japan . | |
| 59-42059 | 3/1984 | Japan . | |
| 59-107234 | 7/1984 | Japan . | |
| 59-124857 | 7/1984 | Japan . | |
| 59-127763 | 7/1984 | Japan . | |
| 60-48355 | 3/1985 | Japan . | |
| 60-36230 | 3/1985 | Japan . | |
| 60-234845 | 11/1985 | Japan . | |
| 2160820 | 1/1986 | United Kingdom | 101/DIG. 27 |

*Primary Examiner*—David A. Wiecking

*Attorney, Agent, or Firm*—Fleit, Jacobson, Cohn & Price

[57] ABSTRACT

Method and apparatus for synchronously controlling a printing speed of a belt-type printing machine including a plate cylinder, a tension roll for adjusting a distance between the plate cylinder and the tension roll, and an endless printing belt detachably wound around the plate cylinder and the tension roll. According to the present invention, sprocket wheels each having thereround sprocket pins for engaging perforations of the endless printing belt are rotatably mounted on the plate cylinder so that the sprocket wheels have no function of driving the endless printing belt and are only intended to guide the belt along a predetermined path and prevent it from lateral movement relative to the plate cylinder. The endless printing belt is driven only by a frictional force between the peripheral surface of the plate cylinder and the belt. With independently detecting the number of rotation of the sprocket wheels, i.e. the travelling speed of the endless printing belt and the rotational speed of the plate cylinder, i.e. the reference speed of the printing machine, an error between these speeds, if any, is corrected to synchronously equalize these speeds by a differential gear unit to which main drive for driving the plate cylinder and sub-drive for correcting the error are inputted.

3 Claims, 6 Drawing Sheets

METHOD AND APPARATUS FOR SYNCHRONOUSLY CONTROLLING THE PRINTING SPEED OF BELT-TYPE PRINTING MACHINE

BACKGROUND OF THE INVENTION

The present invention relates to a method and an apparatus for synchronously controlling the printing speed of a belt-type printing machine.

Conventionally, a single faced corrugated board is manufactured by forming corrugations in a medium web of paper and then by gluing a liner web of paper onto the corrugation crests on one of the sides of the medium web. A liner web of paper is glued onto the corrugated crests on the other side of the medium web to form a double faced corrugated board. In these cases it is preferable to print the desired pattern on the liner or liners prior to formation of the corrugated board in order to obtain an excellent printing appearance and to avoid lowering of the compressive strength of the corrugated board, which would occur due to passage of the corrugated board through printing machine.

In a conventional rotary printing machine, the length of the printed area of the web is limited by the circumferential length of the plate drum and therefore it is impossible to print a pattern of long length exceeding the circumferential length of the plate drum. In addition, a large blank or wasted space remains between adjacent printed areas once every rotation of the plate drum when the printing is carried out by a printing plate having a shorter length than the circumferential length of the plate drum.

For solving these problems, a belt-type printing machine has been recently proposed. As shown in FIG. 6, the belt-type printing machine of prior art usually comprises a plate cylinder 10, a tension roll 12 arranged for adjusting a distance between the plate cylinder 10 and the tension roll 12, and an endless printing belt 14 of synthetic resin film detachably wound around the plate cylinder 10 and the tension roll 12 and travelling therearound in one direction. A printing plate or plates 16 have characters or patterns formed thereon and are affixed on the printing belt 14. Accordingly, it is able to print the characters or patterns on a continuous sheet of paper 20 passing it between the plate cylinder 10 and an impression cylinder 18 arranged close to the plate cylinder 10. According to the belt-type printing machine, the length of printed patterns is not limited by the circumferential length of the plate cylinder 10 and therefore a printed area of any desired length can be conveniently made on the continuous sheet of paper merely by changing the length of either the endless printing belt 14 or the printing plate 16.

As clearly shown in FIG. 6, the belt-type printing machine of prior art is provided with sprockets which are mounted on the opposite ends of the plate cylinder 10 and have a plurality of sprocket pins 10*a* adapted to engage perforations 14*a* formed in the printing belt 14 along its longitudinal edges. During the rotation of the plate cylinder 10, the sprocket pins 10*a* act not only to prevent the endless printing belt 14 from its lateral movement on the plate cylinder 10 but also to drive the belt 14.

However, a slight speed differential tends to arise between the travelling speed of the printing belt 14 and the speed of rotation of the plate cylinder 10 (more in detail the peripheral velocity of the plate cylinder 10), this differential being generally increased cumulatively. This causes misalignment and interference between the sprocket pins 10*a* and the perforations 14*a* of the printing belt 14, which damages the perforations 14*a* and greatly lowers the durability of the belt 14. In addition, the speed differential between the belt 14 and the plate cylinder 10 (the speed of the printing cylinder 10 is same as a line speed of a series of printing machines) sometimes causes an unevenness of color and/or a shear when carrying out a multiple-color printing by using a plurality of type printing machines arranged in series.

Such a phenomenon of causing the speed differential is remarkably found especially when a large printing plate 16 is affixed onto the printing belt 14. The reason why the speed differential is caused will be inferred from following considerations. According to the belt-type printing machine shown in FIG. 6, the endless printing belt 14 is driven not only by a frictional driving force between the belt 14 and the plate cylinder 10 but also by a driving force due to an engagement of the sprocket pins 10*a* with the perforations 14*a* of the belt 14. With this arrangement, there would arise a differential between driving forces given by the frictional force of the plate cylinder 10 and the engagement of the sprocket pins 10*a* with the perforations 14*a* since the flexibility of the printing belt 14 is lowered owing to the affix of the large printing plate 16 onto the printing belt 14. Such a driving force differential will cause the speed differential as set out above. Other various factors such as an unevenness in thickness of the endless printing belt 14, the printing plate 16 and an adhesive tape (not shown) for affixing the printing plate 16 onto the printing belt 14 will complicatedly act each other and give influences to the speed differential between the printing belt 14 and the plate cylinder 10. It has been found that such a speed differential develops a tendency of both increasing and decreasing the travelling speed of the endless printing belt 14.

SUMMARY OF THE INVENTION

The present invention is proposed for eliminating the defects of the belt-type printing machine of prior art and it is an object of the present invention to provide a novel belt-type printing machine in which the travelling speed of the endless printing belt is always synchronized with the line speed of the printing machines and a smooth engagement of the sprocket pins with the perforations of the printing belt is always attained so as to prevent an unevenness of color and/or a shear in printing when carrying out a multiple-printing by using a plurality of belt-type printing machines arranged in series.

According to the present invention, provided is a method for synchronously controlling a printing speed of a belt-type printing machine including a plate cylinder, a tension roll for adjusting a distance between the plate cylinder and the tension roll, and an endless printing belt detachably wound around the plate cylinder and the tension roll, said method comprising the steps of: detecting a line speed of said printing machine as a reference speed and a travelling speed of said endless printing belt; and, controlling the speed of rotation of said plate cylinder on the basis of a differential between the detected speeds so as to synchronously equalize the travelling speed of said endless printing belt with said reference speed.

Further, according to the present invention, provided is an apparatus for synchronously controlling a printing speed of a belt-type printing machine including a plate cylinder, a tension roll for adjusting a distance between the plate cylinder and the tension roll, and an endless printing belt detachably wound around the plate cylinder and the tension roll comprising: means for detecting a line speed of said printing machine as a reference speed; means for detecting a travelling speed of said endless printing belt; comparator means for comparing the detected travelling speed of said endless printig belt with the detected reference speed; and, means for controlling the speed of rotation of said printing cylinder on the basis of signal from said comparator means so as to synchronously equalize the travelling speed of said endless printing belt with said reference speed.

BRIEF DESCRIPTION OF THE DRAWINGS

Other objects and advantages of the present invention will become apparent from the following detailed description of a preferred embodiment of the present invention taken in reference to the accompanying drawings in which.

DESCRIPTION OF THE PREFERRED EMBODIMENT

Figure 5:
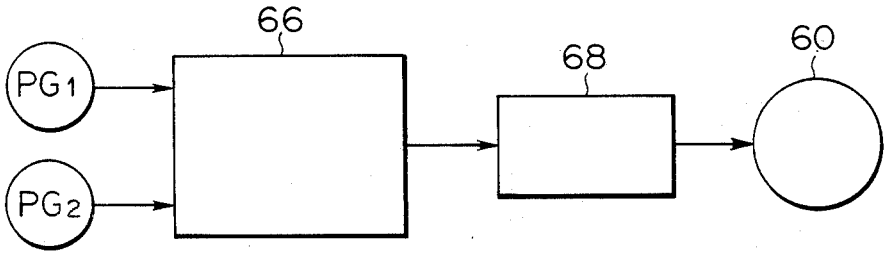
FIG. 5 is a block diagram of an electronic controlling circuit.
Figure 6:
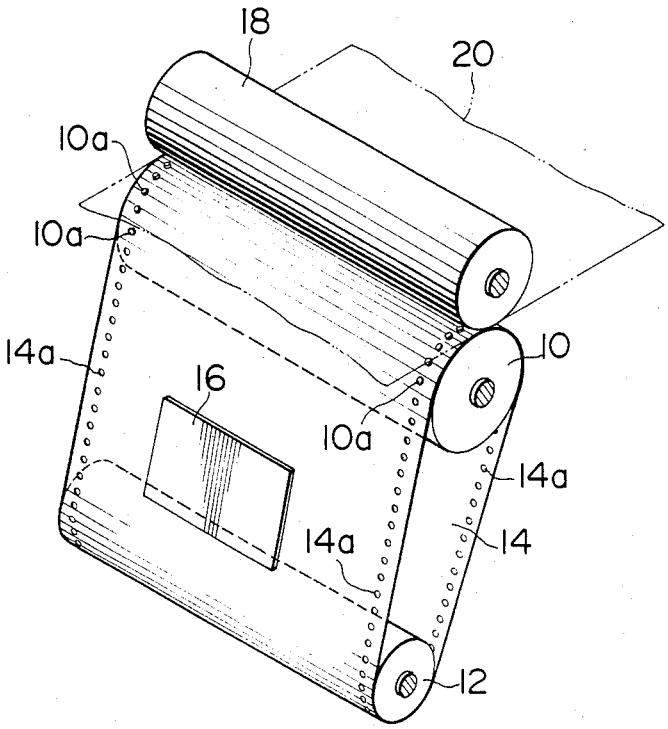
FIG. 6 PRIOR ART
FIG. 6 is a perspective view schematically showing the belt-type printing machine of prior art.

A method and an apparatus for synchronously controlling the printing speed of the belt-type printing machine of the present invention will be explained with reference to FIGS. 1 through 5 in which the same reference numerals are used for designating the same elements shown in FIG. 6.

Figure 3:
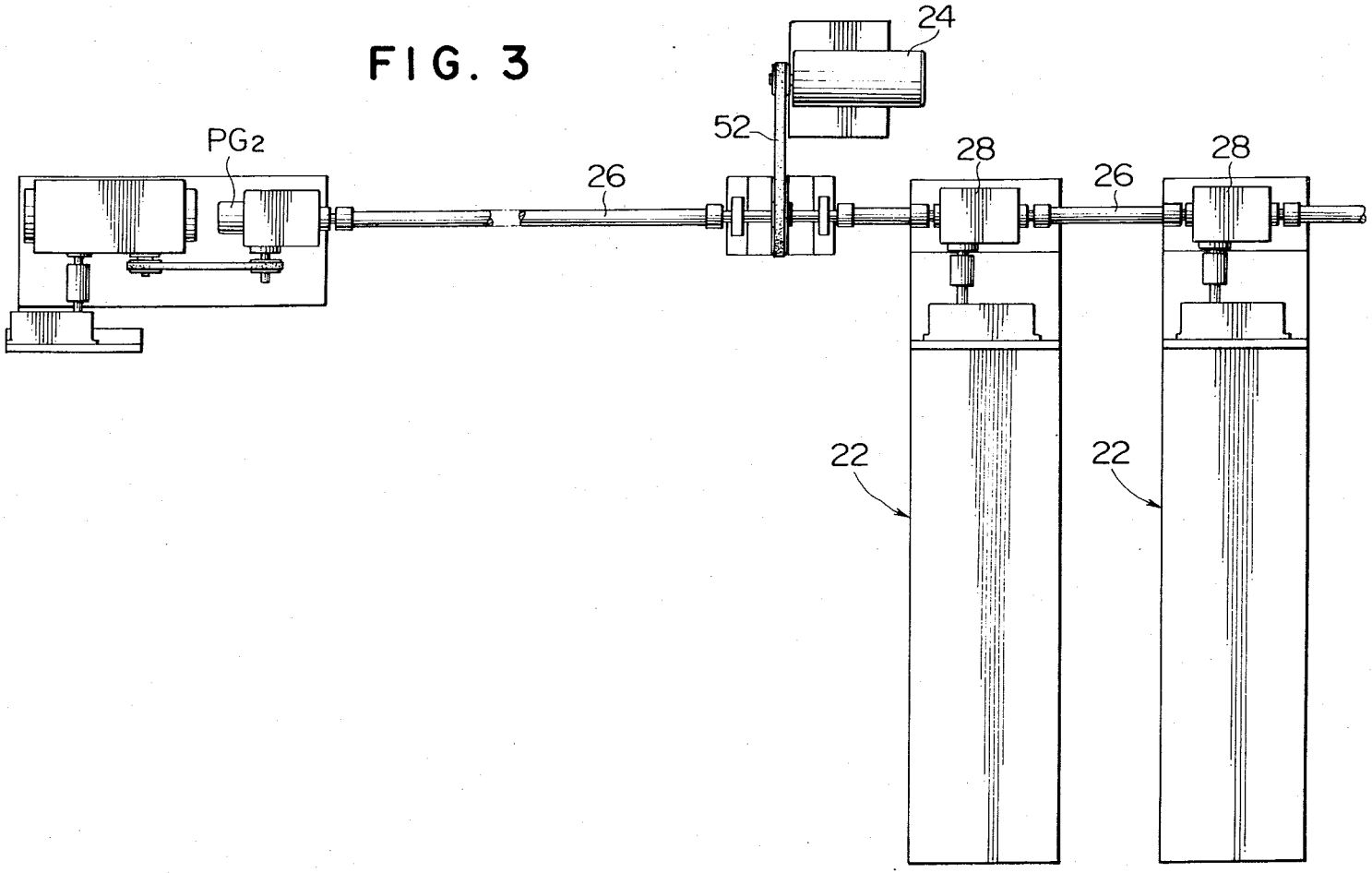
FIG. 3 is a plan view showing a power transmitting line for transmitting a power from a power source to multiple belt-type printing machines.
Figure 4:
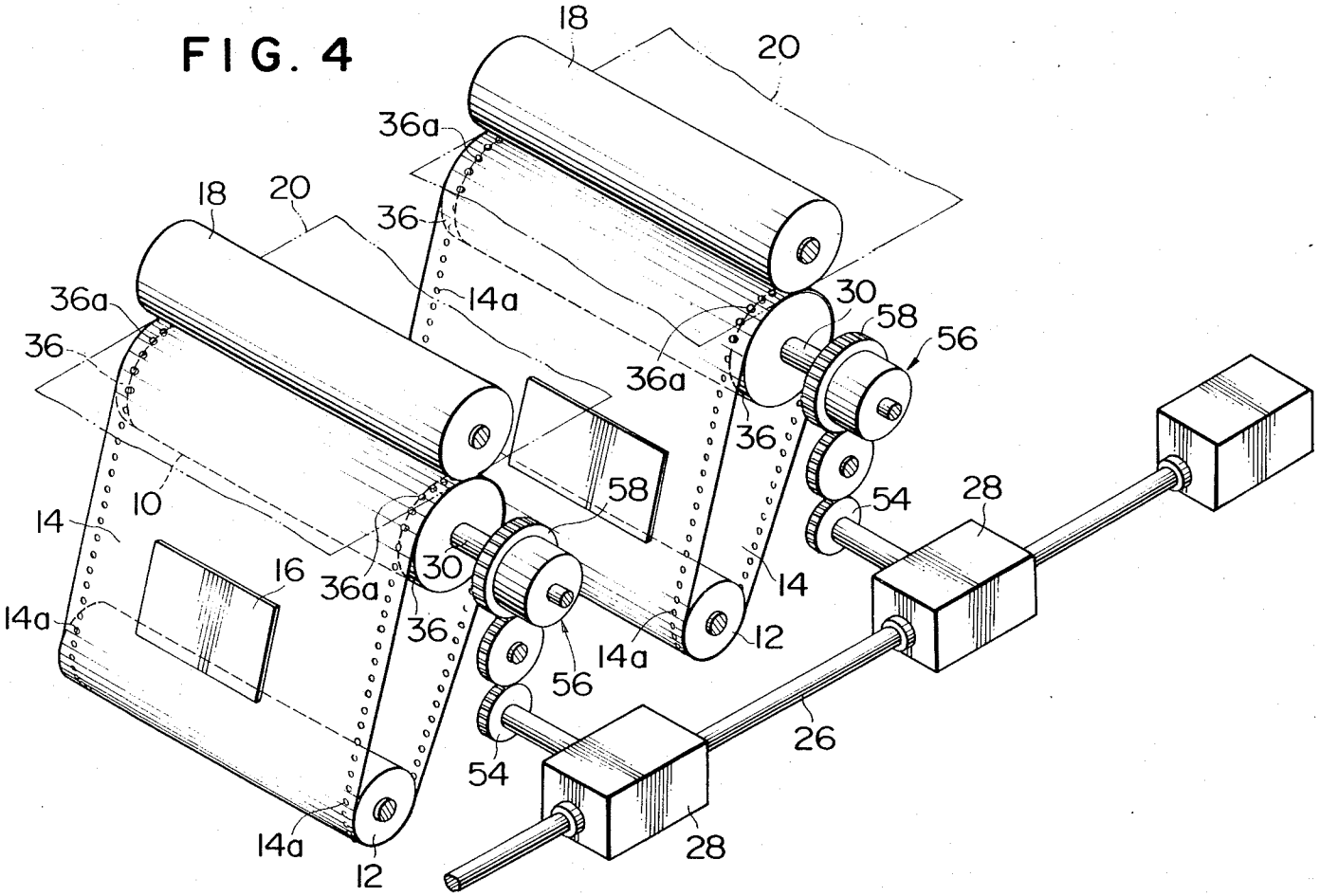
FIG. 4 is a perspective view schematically showing the multiple belt-type printing machines of the present invention.

As shown in FIGS. 3 and 4, arranged in series are multiple belt-type printing machines 22 each of which having a plate cylinder 10, a tension roll 12 for adjusting a distance between the plate cylinder 10 and the tension roll 12, and an endless printing belt 14 detachably wound around the plate cylinder 10 and the tension roll 12. As shown in FIG. 3, a power from a common power source 24 is distributed to the plate cylinder 10 of each belt-type printing machine 22 through a line shaft 26 and a reduction gear 28, which will be hereinafter explained more in detail.

Figure 2:
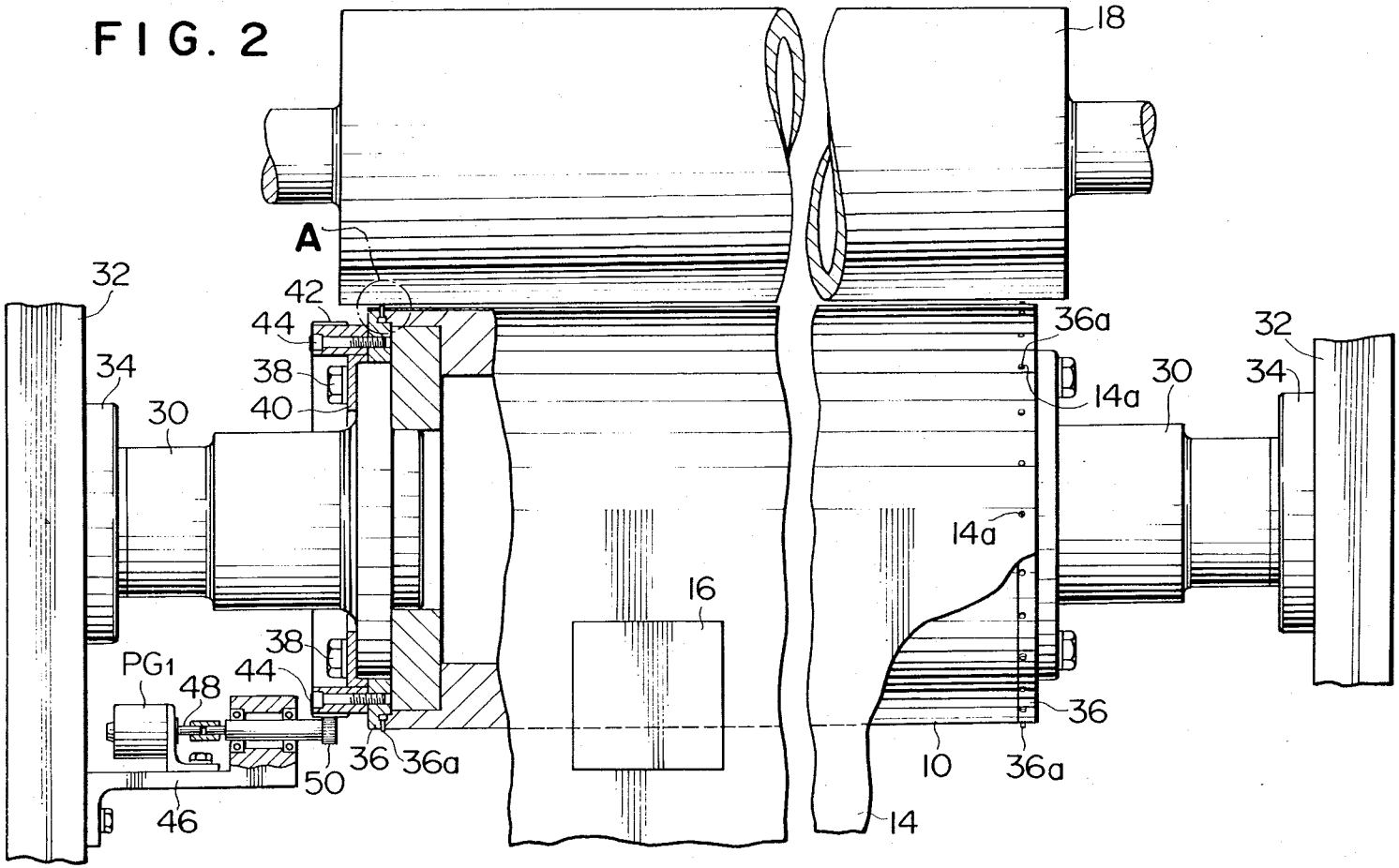
FIG. 2 is a partial sectional view showing a sprocket wheel freely rotatably mounted on the plate cylinder.
Figure 2A:
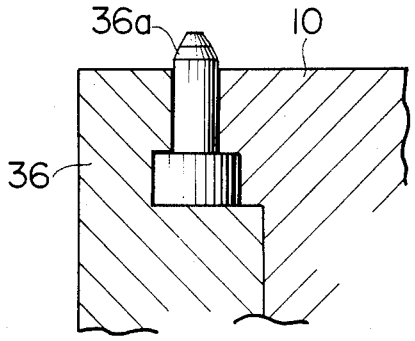
FIG. 2A is a view showing in enlarged scale a portion encircled by A in FIG. 2.
Figure 2B:
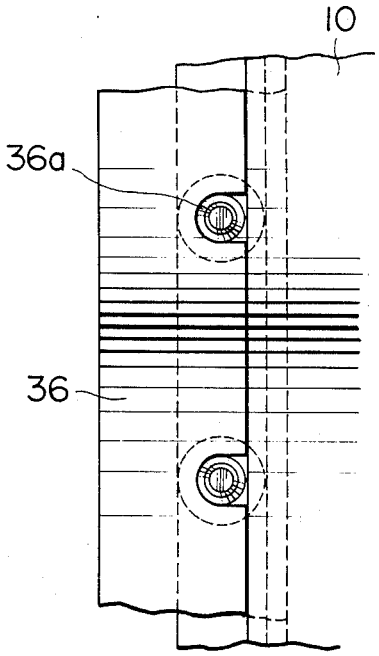
FIG. 2B is a plan view of the portion illustrated in FIG. 2A.

As shown in FIG. 2, a shaft 30 of the plate cylinder 10 is rotatably supported by bearings 34 held in opposite vertical frames 32. A main drive is transmitted to the shaft 30 through the line shaft 26, the reduction gear 28 and a gear train (hereinafter explained).

A sprocket wheel 36 is mounted on each end of the plate cylinder 10 for free rotation relative to the plate cylinder 10, as clearly shown in FIG. 2. The outermost periphery of the sprocket wheel 36 has a diameter substantially identical to that of the plate cylinder 10 and is provided with a plurality of circumferentially spaced sprocket pins 36*a* engageable with perforations 14*a* formed in the endless printing belt 14 along its longitudinal edges at the same pitch as the sprocket pins 36*a*. Each sprocket wheel 36 is freely rotatably fitted onto the stepped end of the plate cylinder 10 defined by an enlarged flange of the shaft 30 and retained in place by an annular ring 40 which is in turn secured to the enlarged flange of the shaft 30 by means of bolts 38. An annular gear 42 is fixed to the outer end face of the sprocket wheel 36 by means of bolts 44 so that the annular gear 42 is centrally aligned with the axis of the shaft 30.

With this arrangement, the endless printing belt 14 is driven only by a frictional force between the belt 14 and the peripheral surface of the plate cylinder 10 and is never driven by the sprocket pins 36*a*. During the travel of the endless printing belt 14, engagement of the sprocket pins 36*a* of the wheel 36 with the perforations 14*a* of the belt 14 results in rotation of the sprocket wheels 36. Accordingly, the sprocket wheel 36 and therefore the sprocket pins 36*a* have only a function of guiding the endless belt 14 for preventing the belt 14 from its lateral movement relative to the printing cylinder 10.

A pulse generator $PG_1$ is mounted on one of the vertical frames 32 through a blacket 46. Mounted on the rotational shaft 48 of the pulse generator $PG_1$ is a pinion 50 which meshes with the annular gear 42 for detecting the number of rotations of the sprocket wheel 36. The pulse signal outputted from the pulse generator $PG_1$, is inputted to a comparator circuit 66 which is shown in FIG. 5 and hereinafter explained more in detail.

Figure 1:
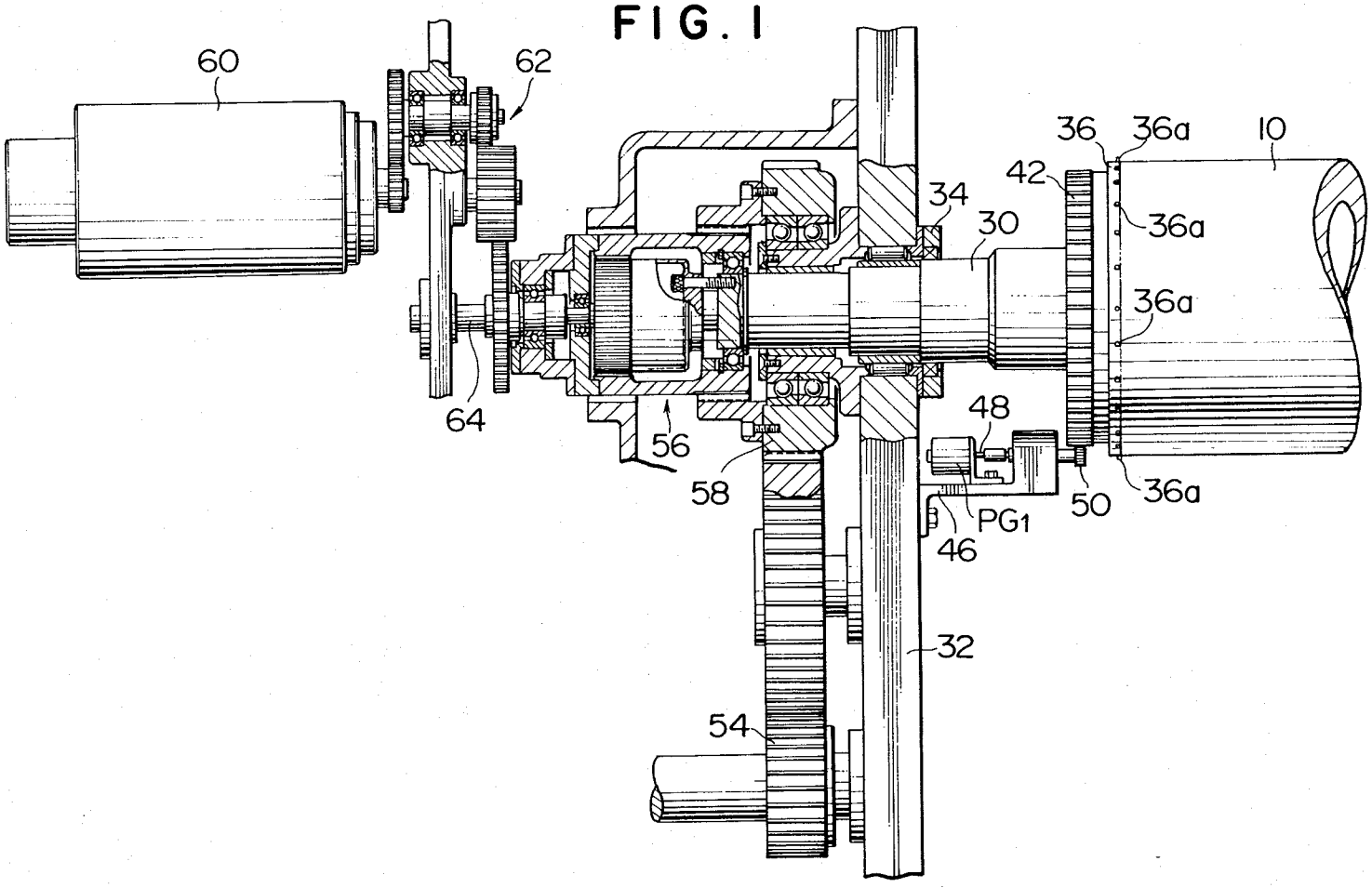
FIG. 1 is a partial sectional view of a preferred embodiment of a synchronous controlling apparatus of the present invention showing a power transmitting train for transmitting a main drive and a sub-drive to the plate cylinder.

FIG. 3 shows a power transmission system of main drive and FIG. 1 shows a power transmission system of sub-drive for the printing cylinder 10. As shown in FIG. 3, the rotation of a motor 24 of common power source is initially transmitted to horizontal line shafts 26 through a belt 52 and then transmitted to each belt-type printing machine 22 through reduction gears 28 each arranged between the line shafts 26. A driving gear 54 (FIG. 1) fixed to the output shaft of the reduction gear 28 meshes with an input gear 58 of a suitable differential gear unit 56 (for example, a "harmonic drive" mechanism, the products of "HARMONIC DRIVE" corp.) to transmit the power to the shaft 30 of the printing cylinder 10. As clearly shown in FIG. 1, an output power from a servomotor 60 is also inputted to a sub-input shaft 64 of the differential gear unit 56. Accordingly, the speed of rotation of the plate cylinder 10 which is rotated by the main drive from the common power source 24 can be increased or decreased when the subdrive from the servomotor 60 is inputted to the differential gear unit 56. Since the harmonic drive mechanism itself is well known, no more detail is explained herewith.

As shown in FIG. 3, one end of the line shaft 26 is connected to another pulse generator $PG_2$ for detecting the line speed, i.e. reference speed of all belt-type printing machines 22 and outputting a reference pulse signal corresponding to the reference speed. The reference pulse signal is inputted to the comparator circuit 66 (FIG. 5) which is adapted to compare the pulse signal from the pulse generator $PG_1$ with the reference pulse signal from the pulse generator $PG_2$ and outputs a calibration signal synchronized with the line speed to a servo amplifier 68. The rotation of the servomotor 60 controlled by the servo amplifier 68 is transmitted to the differential gear unit 56 through the sub-input shaft 64 and increases or decreases the rotation of the plate cylinder 10 so as to synchronize the travelling speed of the endless printing belt 14 with the speed of rotation of the plate cylinder 10. When the travelling speed of the endless belt 14 and the speed of rotation of the plate cylinder 10 are exactly equal to each other, no calibration signal from the comparator circuit 66 is outputted to the servo amplifier 68 and therefore the plate cylinder 10 is driven only by the main drive in such a case.

As can be clearly understood from the above descriptions, it is able, according to the present invention, to exactly synchronize the travelling speed of the endless belt with the speed of rotation of the plate cylinder over all belt-type printing machines, which enables the multiple belt-type printing machines to carry out a fine multiple-color printing free from an unevenness of color and/or a shear in printing. In addition, since the sprocket pins are mounted on the sprocket wheels which are formed as separate parts from the plate cylinder and freely rotatable relative to the plate cylinder, the endless printing belt is driven from the plate cylinder only by their frictional force and is not driven by the sprocket pins. This avoids any damage to the perforations of the endless printing belt.

The present invention has been described with reference to the preferred embodiment. Obviously, modifications and alternations will occur to those of ordinary skill in the art upon reading and understanding the preceding detailed description. It is intended that the present invention be construed as including all such alternations and modifications insofar as they come within the scope of the appended claims or the equivalents thereof.

What is claimed is:

1. A method for synchronously controlling a printing speed of a belt-type printing machine including a plate cylinder, a tension roll for adjusting a distance between said plate cylinder and said tension roll, and an endless printing belt detachably wound around said plate cylinder and said tension roll, said method comprising the steps of:

detecting a line speed of a drive means for said plate cylinder as a reference speed, engaging perforations formed along longitudinal edges of said endless printing belt with circumferentially spaced sprocket pins arranged around freely rotatable sprocket wheels located at opposite ends of said plate cylinder to prevent lateral movement of said endless printing belt, detecting a traveling speed of said endless printing belt as said endless printing belt is driven by said plate cylinder, comparing said detected line speed against said detected traveling speed, and controlling the speed of rotation of said plate cylinder on the basis of a differential between said detected line speed and said detected traveling speed so as to synchronously equalize said detected traveling speed of said endless printing belt with said reference speed.

2. An apparatus for synchronously controlling a printing speed of a belt-type printing machine including a plate cylinder, a tension roll for adjusting a distance between said plate cylinder and said tension roll, and an endless printing belt detachably wound around said plate cylinder and said tension roll comprising:

means for detecting a line speed of a drive means for said plate cylinder as a reference speed;

means for detecting a traveling speed of said endless printing belt;

comparator means for comparing the detected traveling speed of said endless printing belt with the detected reference speed; and auxiliary means for controlling the speed of rotation of said plate cylinder on the basis of a signal from said comparator means so as to synchronously equalize the traveling speed of said endless printing belt with said reference speed.

3. The apparatus as set forth in claim 2, wherein said plate cylinder is provided at its opposite ends with freely rotatably sprocket wheels, each having circumferentially spaced sprocket pins arranged therearound for engaging perforations formed in said endless printing belt along its longitudinal edges at a same pitch as said sprocket pins to prevent lateral movement of said printing belt relative to said plate cylinder.

* * * * *